United States Patent [19]

Flagg

[11] 4,309,851

[45] Jan. 12, 1982

[54] STRUCTURE OF INFLATABLE TUBES WITH CLOSED LOOP CONNECTORS

[76] Inventor: Rodger H. Flagg, 1415 Lynn Ave., Ft. Wayne, Ind. 46805

[21] Appl. No.: 63,941

[22] Filed: Aug. 6, 1979

[51] Int. Cl.[3] ..... E04B 1/34

[52] U.S. Cl. ..... 52/2; 52/233; 46/20; 46/29; 46/87

[58] Field of Search ..... 46/20, 87, 88, 90, 28, 46/31, 26, 29; 52/2, 233; 403/172, 176, 218, 219, 346, 392; 9/15, 16

[56] References Cited

U.S. PATENT DOCUMENTS

| | | | |
|---|---|---|---|
| 255,048 | 3/1882 | Terry | 9/16 X |
| 811158 | 1/1906 | Maddux | 46/31 |
| 1,201,710 | 10/1916 | Finch | 46/26 |
| 1,638,324 | 8/1927 | Davis | 9/15 |
| 1,845,258 | 2/1932 | Forbes | 46/20 |
| 2,076,956 | 4/1937 | Lowenstein | 46/31 UX |
| 2,635,303 | 4/1953 | Poynter | 46/20 |
| 2,861,388 | 11/1958 | Favaretto | 46/25 |
| 3,120,078 | 2/1964 | Bessinger | 46/31 |
| 3,550,311 | 12/1970 | Fouquart | 46/28 |
| 3,654,052 | 4/1972 | Rye | 46/31 X |
| 3,994,102 | 11/1976 | Johnson | 52/2 |
| 4,093,302 | 6/1978 | Adams | 52/2 X |

FOREIGN PATENT DOCUMENTS

| | | | |
|---|---|---|---|
| 1329466 | 4/1963 | France | 52/2 |
| 1357493 | 2/1964 | France | 46/20 |
| 1552216 | 11/1968 | France | 52/2 |
| 16309 | of 1891 | United Kingdom | 403/392 |
| 14957 | of 1895 | United Kingdom | 46/25 |
| 20678 | of 1895 | United Kingdom | 403/392 |

*Primary Examiner*—F. Barry Shay

*Attorney, Agent, or Firm*—Rodger H. Flagg

[57] ABSTRACT

The modular construction elements are formed of flexible airtight material of common cross-sectional diameter and varied tubular lengths sealed to provide an inflatable chamber. Each chamber is adapted with an air valve for inflation or deflation. The varied tubular lengths, when deflated, may be rolled or folded for storage or transport, and may be orally or mechanically inflated to provide lightweight, flexible modular construction elements suitable for erection of a variety of structural shapes suitable for a child to enter and play within. Associated modular construction elements may be lashed in place, secured with flexible expanding bands, or with grommets and flexible fasteners. When the structure is erected outdoors, the modular construction elements may be pegged to the ground. Doors, windows and roof sections may be added to complete the structure.

8 Claims, 16 Drawing Figures

FIG. 1
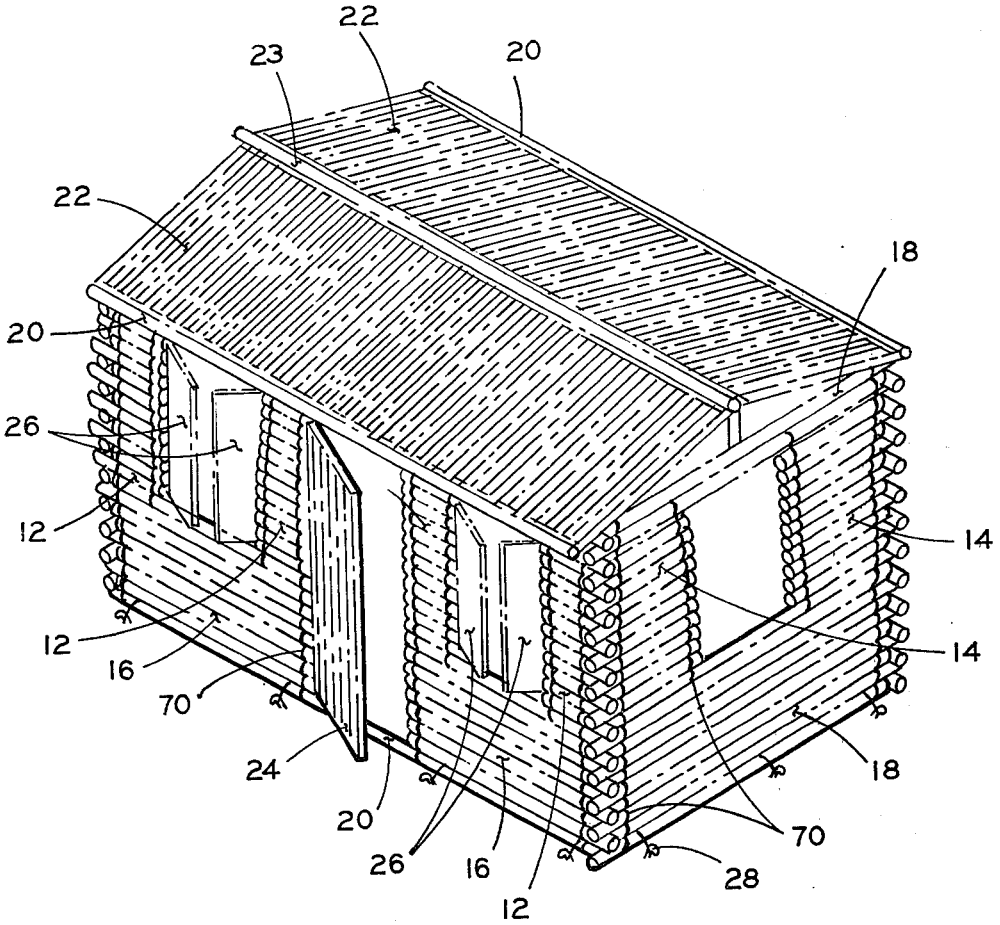
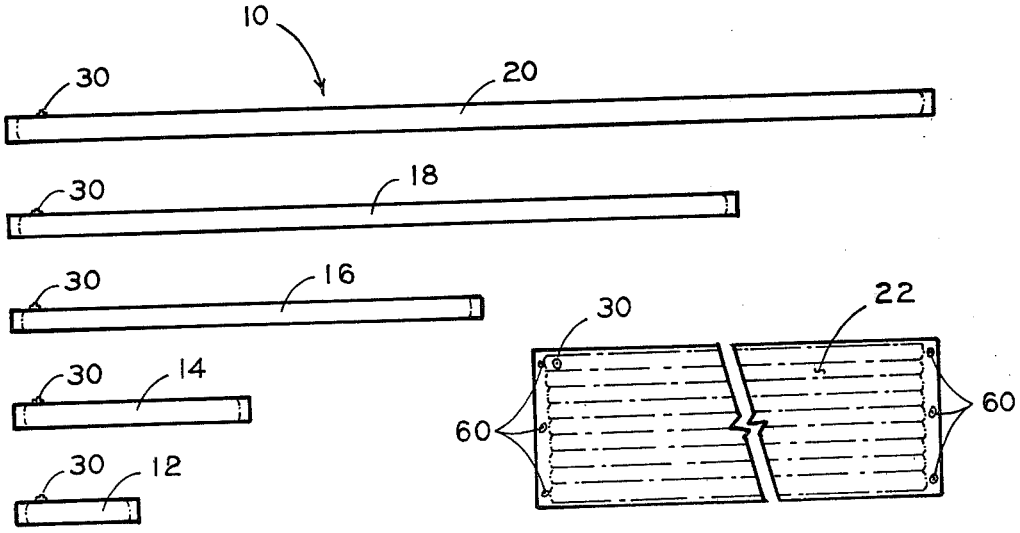
FIG. 2

FIG. 3A
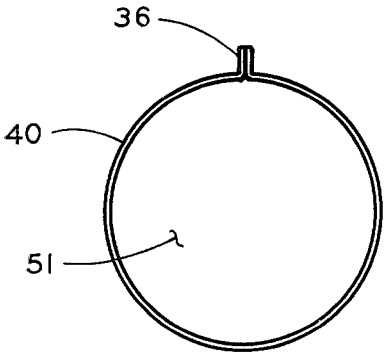
FIG. 3B
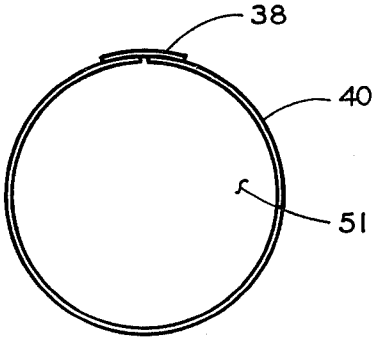
FIG. 3C
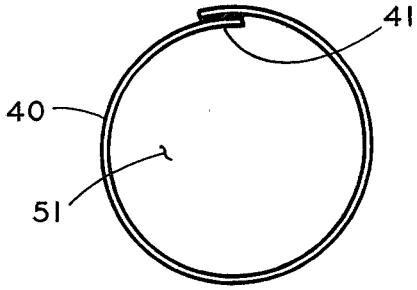
FIG. 3D
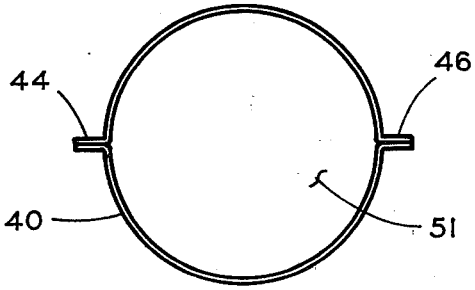
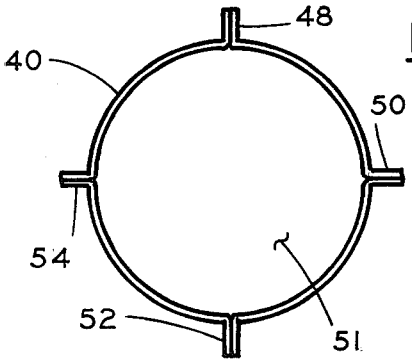
FIG. 3E
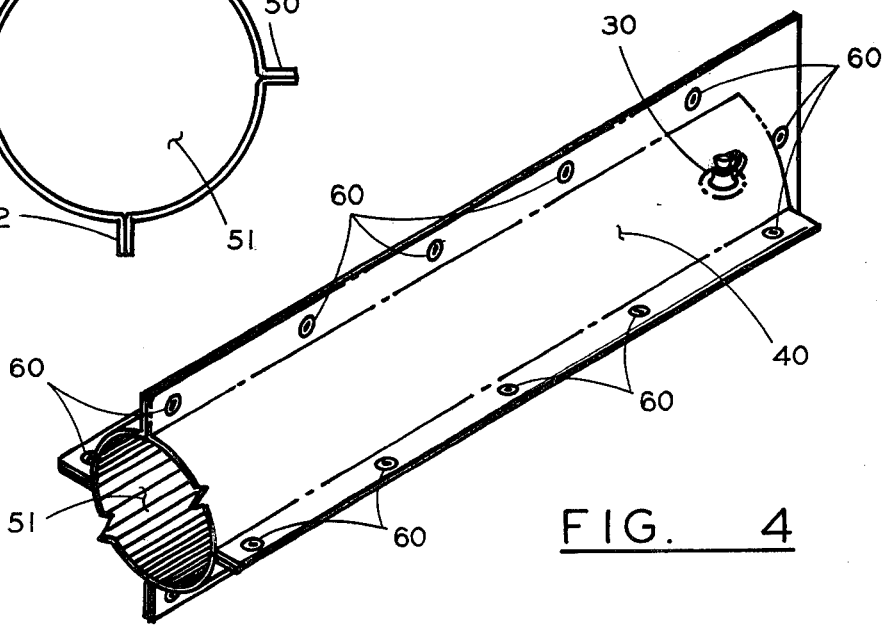
FIG. 4

FIG. 5
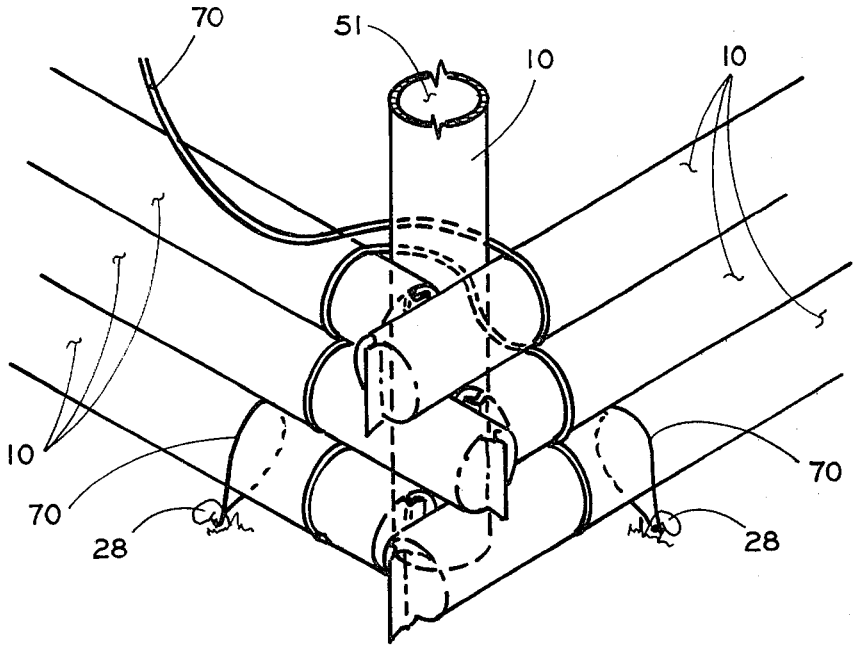
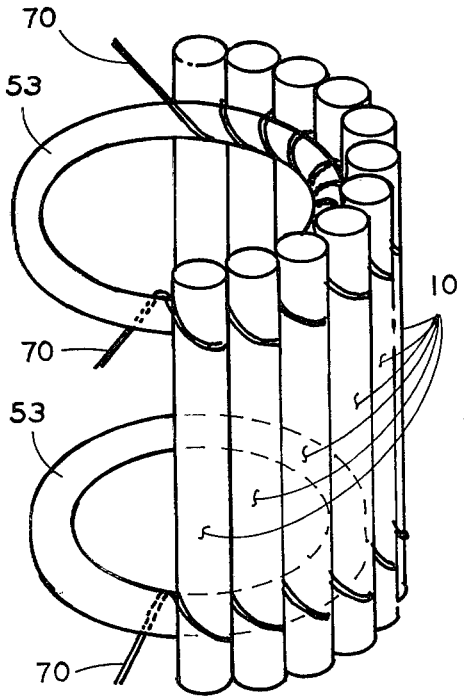
FIG. 6
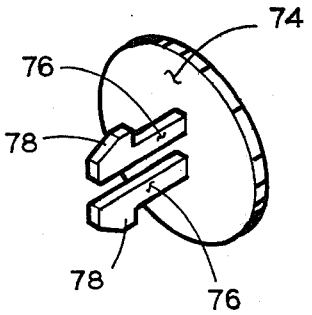
FIG. 7

FIG. 8A
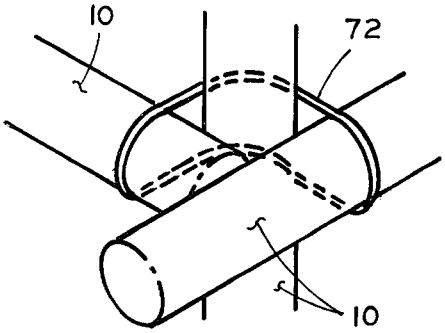
FIG. 8B
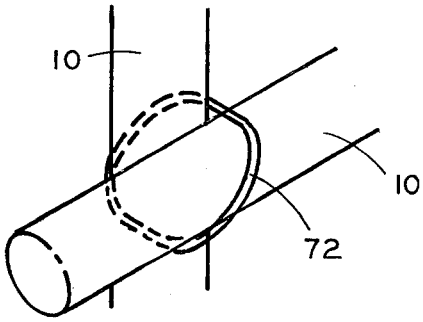
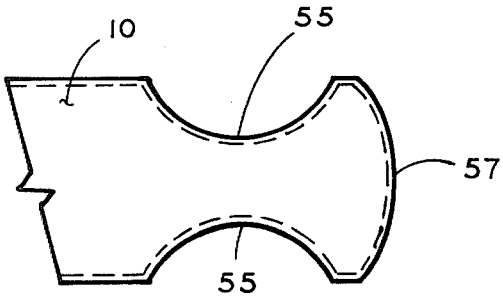
FIG. 9A
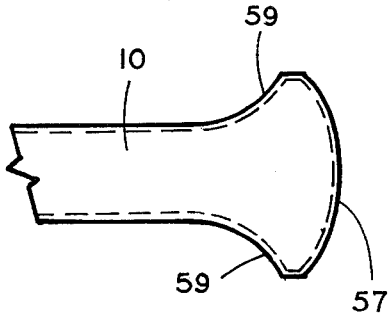
FIG. 9B
FIG. 10
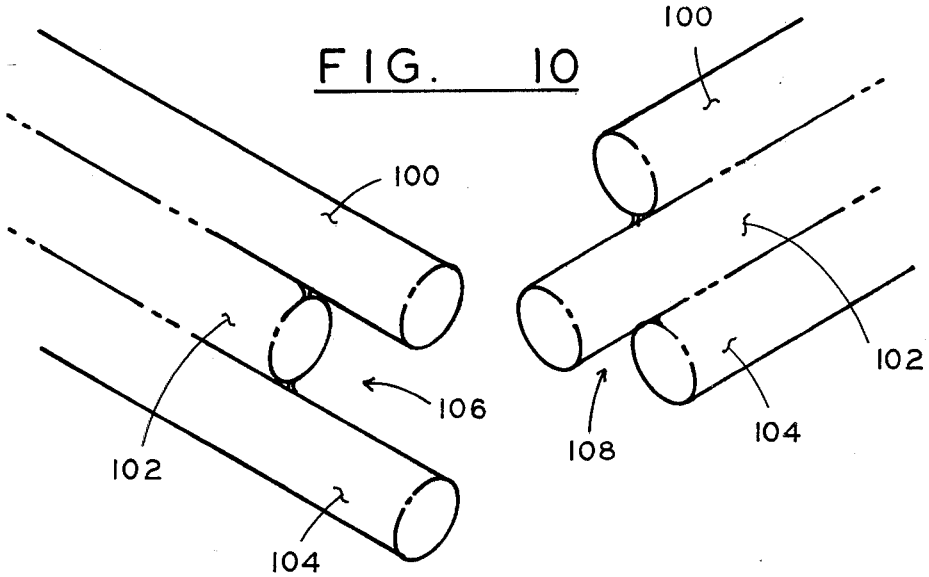

STRUCTURE OF INFLATABLE TUBES WITH CLOSED LOOP CONNECTORS

BACKGROUND OF THE INVENTION

Spatial concepts are traditionally taught with the aid of models to aid conceptualization. Some commercially available model materials designed for use by children include such brand name products as Lincoln Logs, Tinker Toys, Erector Sets, Lego Blocks, etc. With most of these products, the participant is limited to fractional scale constructions too small for the participant to physically enter and actively relate to his construction from within.

Model building to reduced scale has its place, and has achieved popularity with students, teachers and parents. Modular construction elements light enough to be easily handled by a child, yet large enough to enable a child to erect a structure of a size sufficient to enter within, will add a new dimension to traditional model building.

Tinker Toys have attempted to adapt their product to this concept, with only limited success. Tinker Toys' enlarged version can be easily damaged in normal play by active children. Such stick constructions are to basic building materials what stick figures are to figure drawing.

Other attempts to create an environment which a child can play within include cardboard configurations, with details printed thereon. Such constructions are easily damaged by active children and are not suitable for outdoor use where moderate winds or rain are likely.

OBJECTS OF THE INVENTION

One object of the present invention is to provide novel construction materials light enough to be transported by a child, yet large enough to enable a child to quickly erect a structure large enough to play within.

Another object of this invention is to provide a quantity of modular construction materials suitable for erection of a variety of structures, which are limited in scope only by the size and quantity of the modular materials, the methods of securement and the imagination of the builder.

Another object of this invention is to provide a means for a child to orally or mechanically inflate individual modular construction elements in order to aid in conceptualizing the volume of air required to fill a given size and shape.

Another object of this invention is to provide portable modular construction elements suitable for outdoor use by active children, which will take reasonable abuse from wind and weather.

Another object of this invention is to provide portable modular construction elements of varying shapes and lengths, suitable for assembly and disassembly by a child without requiring special tools.

Another object of this invention is to provide a quantity of modular construction elements suitable for erection of a structure of a sufficient size to allow one or more children to enter and play within, which are adapted to be readily disassembled and stored in a small area to eliminate the problems of vandalism prevalent with fixed-in-place outdoor playground equipment.

Another object of this invention is to provide a series of lightweight, modular construction elements in kit form, suitable for erection of a structure of a size for a child to play within, wherein the modular construction elements are sized in varying lengths in multiples of a standard unit length.

Other objects will become obvious to one skilled in the art as he reviews the following drawings, specifications and claims.

DESCRIPTION OF THE DRAWINGS

FIG. 1 is a perspective view of the modular construction elements assembled into an enclosed structure having a roof, four walls, a door, and windows, of a size suitable for a child to erect and play within.

FIG. 2 shows several modular construction elements used in the construction of FIG. 1.

FIG. 3A, 3B, 3C, 3D and 3E show several cross-sectional configurations adaptable for forming an elongated tubular shape suitable for forming various lengths of modular construction elements adapted for inflation.

FIG. 4 shows a perspective view of a tube having the cross-sectional configuration of FIG. 3E, wherein the exposed seams serve to support grommets for use in securing other modular construction elements together.

FIG. 5 shows a perspective sectional view of one corner of the structure shown in FIG. 1, wherein straps or cords ar used to lash modular construction elements together.

FIG. 6 shows the use of a circular construction element adapted to lash other modular construction elements thereto to form a non-linear structure.

FIG. 7 shows a perspective view of a fastening means adapted to secure modular structural elements through grommets without the aid of special tools for insertion or removal.

FIG. 8A and 8B show the use of expansion of bands to secure modular construction elements to each other.

FIG. 9A and 9B show alternate configurations of the ends of the modular construction elements, wherein the ends are sculptured and/or flared to aid positioning and securement.

FIG. 10 shows a multi-tiered modular construction element suitable for interlocking construction.

DETAILED DESCRIPTION OF THE INVENTION

Modular construction elements, generally designated 53 may be fabricated in a variety of shapes and lengths suitable for inflation and erection of a variety of structures by one or more school age children. One such structure is shown in FIG. 1.

The modular construction elements 10, are elongated tubular configurations supplied in a variety of lengths 12, 14, 16, 18 and 20, as shown in FIG. 2. Other lengths as shown by tubes and shapes may be constructed for non-linear constructions as shown in FIG. 6.

Erected structures may be supplied with roof sections 22, door sections 24, and window sections 26, as shown in FIG. 1.

The modular construction elements 10 may be large enough to erect a structure for one or more children to play within. When used outdoors, such structures may be secured to the ground with pegs 28, as is common with tents and other outdoor temporary structures.

Each modular construction element is lightweight, can be adapted for oral or mechanical inflation through air valve 30, can be easily transported by a child, and when deflated, can be rolled or folded compactly into a small area for storage.

Oral or manual inflation of one or more modular construction elements 10 will aid the child in conceptualizing the volume of air contained within a given size and shape.

Fabrication of each modular construction element 10 may be accomplished by any conventional means as shown in cross-section in FIG. 3A, with a single external sealing strip 36. As shown in cross-section in FIG. 3B, an external sealing strip 38 may also be used to form the desired tubular configuration. As shown in FIG. 3C, material 40 has overlap 41 and is sealed to form the desired tubular configuration. As shown in cross-section in FIG. 3D, two pieces of material 40 may be used to form external sealing strips 44, 46. As shown in FIG. 3E, additional sealing strips 48, 50, 52, 54 may be adapted to provide any desired quantity of external sealing strips suitable for supporting grommets 60, when used for securing modular construction elements as shown in FIG. 7.

Thus it can be seen that the modular construction elements may be formed in any desired tubular length, with air valve 30 suitably placed through material 40, and the ends of each tubular length sealed to form an air tight chamber 51 suitable for inflation within each modular construction element 10.

The preferred diameter of the modular construction element is from one inch diameter through twelve inches in diameter, with two through six inch diameters considered best.

The preferred lengths of each modular construction element range from one foot long through twenty feet long. While it is understood that modular construction elements may be larger or smaller than these sizes, it is believed that the majority of the modular construction elements in kit form will fall within this length range.

Any material suitable for sealing and inflation may be used.

Heat sealing, sonic bonding, gluing and other conventional means may be used to provide a suitable airtight seal.

Air valve 30 is adapted to pass air into each modular construction element for inflation, and to release air within the modular construction element for deflation. Each modular construction element is normally inflated during use, and deflated for shipping, storage, etc.

A patch kit may be supplied to repair leaks should they occur in a modular construction element.

Where inflation is not desired, each modular construction element 10 may be made of urethane foam, or other suitable lightweight material, suitable for handling by a child in the lengths and diameters mentioned herein. Such constructions would tend to be heavier than air filled elements, and lack the capacity for deflation for storage in a small space.

The ends of each modular construction element 10 may have a sculptured annulus 55 or have a flare 59, as shown in FIGS. 9A, 9B respectively to improve the "nesting" of associated modular elements.

As shown in FIG. 10, each modular construction element 10 may consist of several joined tubular shapes 100, 102, 104, which may be staggered as at the ends 106, 108 to provide interlocking construction without requiring an external fastening means.

Roof sections 22, door sections 24 and window sections 26 may be made of a series of joined tubular shapes, suitably sized. Where desired, window units may be made of transparent or light transmissive material suitable for inflation. Of course, these tubular shapes may be adapted to be opened or removed for ventilation within.

Securement of the modular construction elements during erection of a structure may be provided by cord or straps 70, by lashing modular elements 10 to each other or to a vertical element 10, as shown in FIG. 5. Such fastening means are easily handled by a child, are easily removable, and require no special tools. Vertical element 10 may be placed within or without the joint.

Another means of securement of associated modular construction elements 10, is with the use of flexible closed loop expansion bands 72 sized to expand to pass over associated elements, and when released, contract to secure inflated elements in place.

FIG. 7 shows a fastening means 74 adapted to pass through associated grommets 60, and expand to secure associated elements 10. Such fastening means 74 may be inserted from one side of structure by pushing prongs 76 through aligned grommets 60 until tabs 78 pass through grommets 60 and expand to secure fastening.

To remove fastening means 74, tabs 78 are compressed and pushed through aligned grommets 60. No special tools are required. Fastening means 74 may be left within one grommet 60 in preparation for later use, to minimize loss of fastening means 74.

Where lashing is used, cord or strap 70 is tightened about modular construction elements, which locally compresses modular elements 10, providing a safe, flexible yet slide resistant means of securement.

Since the walls are inflatable, they are by nature flexible, offering rugged, yet resilient surfaces both within and without the structure. Children may accidentally run headlong into such a structure without serious damage to themselves or the modular elements 10. This is not true of other conventional construction materials. Thus these modular construction elements 10 are ideal for indoor or outdoor playground use, and may be compactly dismantled, deflated and stored when not in use to minimize vandalism.

The modular construction elements 10 are non-corrosive, and offer no sharp edges to cut, scratch or splinter.

Such elements 10 may be arranged in a variety of configurations, and are well suited to constructive play by one or more children, developing coordination, building skills, and social interaction.

In order to provide a kit of modular construction elements of common cross sectional diameter and varied tubular lengths suitable for erection of a variety of shapes, it has been found that a greater quantity of tubular lengths are eight feet or less, while a lesser quantity of tubular lengths is greater than eight feet in length. For individual play, kits with all tubular lengths less than eight feet in length are suitable. The smaller kits may have no tubular lengths in excess of four feet in length.

In most cases the inflatable material used will not weigh less than one ounce per linear foot of tubular length, nor more than two pounds per linear foot of tubular length.

OPERATION OF THE INVENTION

The modular construction elements 10 shown in FIG. 2 will normally be packaged in kits, suitable for a variety of construction projects within a given size range. Each kit will contain a variety of tubular lengths. Each modular construction element will have an inflation valve 30. In addition, there will normally be pictures or blueprints of sample projects, and a mechanical inflation means suitable for use by children.

To begin construction, a suitable site is chosen. Modular construction elements 10 may be inflated in advance, or as needed; either orally or by mechanical means.

Inflation pressures need be only sufficient to provide full extension of the modular element 10. Pressures of 1 to 6 p.s.i. above ambient are sufficient. Once inflated, air valve 30 is adapted to prevent loss of air through the valve. Due to the light weight of each modular construction element, a child may easily pick up lengths longer than the child is tall, position and stack these modular elements 10, and secure them in place. Long lengths for larger projects will normally be handled by more than one child.

When the structure is to be placed outside, where winds may blow the structure, the base modular units may be staked by pegs 28 in place, as is common with portable shelters.

Each modular element 10 may be positioned and secured, working from the ground up, as practiced in the building trades, or entire wall sections may be prefabricated by positioning modular elements 10 and securing associated elements on the floor, then raising the entire wall section for securement to adjoining walls, to suit the young builder.

Modular construction elements 10 are selected for length to provide the desired openings for doors and windows. Vertical modular elements 10 are positioned and secured at each end of the modular elements to join and strengthen the wall joints. Vertical modular elements may be within or without the structure to suit the builder.

Where lashing with cord or strap 70 is used to secure the modular construction elements 10, the cord or strap is alternately wrapped around first one modular element 10, behind the vertical modular element 10 and then around the joining modular element 10, drawing the two modular elements to the vertical element. As the lashing is drawn taut, the modular elements are compressed against the internal inflation pressure, which serves to secure the joint and resist lateral slippage. Periodically, the lashing may be tied off to prevent inadvertent loosening.

Upon completion of each wall section, the lashing is tied off, securing the joint during use.

Where grommets 60 are used, fasteners 74 as shown in FIG. 7, may be used to secure the modular elements 10 together. To install fastener 74 grommets 60 are aligned and fastener prongs 76 are pushed through grommets 60. Once through the grommets, tabs 78 expand to secure the aligned grommets together.

When fastener 74 removal is desired, tabs 78 are compressed and pushed through grommets 60, releasing the modular construction elements 10. Fastener 74 may be left in one grommet between use to minimize loss.

Where a roof is desired, as shown in FIG. 1, roof sections 22 are secured to the roof ridge 23 and the top of the wall sections by any of the aforementioned securement methods.

Doors and windows may be hinged with flexible expanding straps to provide rotational movement during active play. Strap or cord 70 may also be used to retain doors or windows in their desired positions.

Neither doors nor windows are necessary construction elements, but are considered options.

Erected structures may be left standing where vandalism is not a problem, or they may be easily disassembled, and stored for later use. Where structure has been pegged to the ground, weather conditions such as moderate wind or rain will not damage the erected structure. When disassembly is desired, each modular construction element 10 is removed in reverse order from the order of erection.

After removing each modular construction element 10, the element is deflated by allowing the air within the chamber to pass through air valve 30. Each modular construction element 10 may then be folded or rolled for compact storage.

The securement means may also be gathered up and stored, in anticipation of further use.

Due to the flexible nature of the modular construction elements 10, a great variety of structures may be erected from a basic kit. Thus the play value expands as the child's abilities to work with the kit and his imagination expands.

Although the present invention has been illustrated and described in connection with a few selected example embodiments, it is understood that these are illustrative of the invention and are by no means restrictive thereof. It is reasonable to expect that one skilled in the art can make numerous revisions and adaptations of the invention and it is intended that such revisions and adaptations will be included within the scope of the following claims:

What is claimed is:

1. A modular building construction for child's play comprising:

a plurality of separate, inflatable, elongated tubes;

one of said tubes being substantially upright and comprising a post;

a first plurality of second tubes being positioned substantially horizontally, and vertically stacked one over the other to form a substantially continuous planar upstanding first wall section, respective ends of said second tubes defining a wall section side and said second tubes being tangent to said post;

a plurality of flexible closed loop bands removable from said tubes, each of said bands being adapted for releasably attaching at least one of said second tubes to said post in snugly engaged relation to resist substantial relative movement between said tubes and said post to provide ease of assembly and to maintain said second tubes in the configuration of said wall section, and for providing relative movement between, and ease of disassembly of, said second tubes and said post when said band is removed.

2. The construction of claim 1 including a second upstanding planar wall section of second tubes having tube ends positioned adjacent to said post and said tube ends of said first wall section;

said flexible band releasably attaching said tubes of said second wall section to said post whereby said first and second wall sections are releasably held to each other and to said post, said first and second sections have a predetermined corner angle therebetween.

3. The construction of claim 1 including a plurality of said upstanding planar wall sections;

said wall sections being placed in contiguous relation one to another to form a closed walled enclosure; a corner of predetermined included angle being formed between contiguous wall sections; at least one of said sections being provided with an entrance opening;

a plurality of said posts, a post being positioned near each of said corners and tangent to the tubes of the wall sections defining each of said corners;

each one of said bands releasably holding to one of said posts, a respective one of the tubes tangent thereto;

said enclosure being of a size sufficient for a person to enter and move about therewithin.

4. The construction of claims 1, 2 or 3 wherein each of said flexible bands comprises an elastic band stretchable to fit around a respective one of said posts and the end of at least one of said tubes tangent thereto, said each band being resiliently contractable to resist relative movement between its associated post and tubes.

5. The construction of claims 2 or 3 wherein each of said flexible bands comprises an elastic band stretchable to fit around each of said posts and one of a pair of substantially coplanar tubes tangent thereto, said pair of tubes comprising corresponding tubes from contiguous first and second wall sections respectively, and resiliently contractable about said each post and tangent tubes to resist substantial relative movement therebetween.

6. The construction of claim 5 wherein said band is looped around one of said pair of tubes from said first wall section, wrapped around said each post, and looped around the other of said pair of tubes from said second wall section.

7. The construction of claim 6 wherein the end of one of said pair of tubes abuts said other of said pair of tubes.

8. The apparatus of claim 3 including at least one of a window, door, and a roof;

a said window being formed in at least one of said sections;

a said door being formed in at least one of said sections;

said roof being placed over and supported by the upper edges of said wall sections.

* * * * *